US006044998A

United States Patent [19]

Schearer et al.

[11] Patent Number: 6,044,998

[45] Date of Patent: Apr. 4, 2000

[54] BIN HAVING SIDE ACCESS GATE

[75] Inventors: Tim Schearer, Troy; Howard G. Baisch, Shelby Township, both of Mich.

[73] Assignee: Allibert-Contico, L.L.C., Bridgeton, Mo.

[21] Appl. No.: 09/220,737

[22] Filed: Dec. 23, 1998

[51] Int. Cl.[7] ..... B65D 6/18

[52] U.S. Cl. ..... 220/6; 220/1.5; 206/600

[58] Field of Search ..... 220/1.5, 6, 7; 206/600; 160/328

[56] References Cited

U.S. PATENT DOCUMENTS

| | | | |
|---|---|---|---|
| 2,886,105 | 5/1959 | Lee | 160/328 |
| 3,294,034 | 12/1966 | Bodenheimer et al. | 220/1.5 |
| 3,371,815 | 3/1968 | Macomber | 220/1.5 |
| 4,046,186 | 9/1977 | Nordstrom | 160/368.1 |
| 4,775,068 | 10/1988 | Reiland et al. . | |
| 4,799,600 | 1/1989 | Gunn et al. | 220/1.5 |
| 4,917,255 | 4/1990 | Foy et al. | 220/6 |

OTHER PUBLICATIONS

The Ultimate (Collapsible Container Catalog), Allibert Contico, Circa, 1998.

The Allibert Contico Product Catalog, Mar., 1998.

*Primary Examiner*—Stephen Castellano

*Attorney, Agent, or Firm*—Howell & Haferkamp, L.C

[57] ABSTRACT

In general, a bin of the present invention comprises a base portion, opposing first and second side walls, an end wall and an access gate. The side walls are connected to the base portion and extend upwardly therefrom. The end wall is connected to a rearward edge of the base portion and extends upwardly therefrom between the first and second side wall. The access gate includes first and second leg members and at least one article retainer. The first leg member is operatively connected to a forward edge of the base portion, adjacent the first side wall, and extends generally upwardly from the base portion. The second leg member is operatively connected to a forward edge of the base portion, adjacent the second side wall, and extends generally upwardly from the base portion. The first and second leg members define the left and right margins of an access opening in the gate. The article retainer has a first end and a second end. The first end of the article retainer is connected to the first leg member of the gate. The article retainer is operable between an extended condition and an unextended condition. When the article retainer is in its extended condition, it spans the access opening between the first and second leg members in a manner to prevent articles being carried in an interior of the bin from inadvertently falling out of the bin through the access opening. When the article retainer is in its unextended condition, the second end of the article retainer is movable generally toward the first end of the article retainer to provide unobstructed access to the interior of the bin through the access opening.

24 Claims, 6 Drawing Sheets

BIN HAVING SIDE ACCESS GATE

BACKGROUND OF THE INVENTION

This invention relates generally to storage bins of the type having a base and a plurality of upstanding side and end walls mounted on the base to form sides of the bin. More particularly, the invention pertains to large duty storage bins having gates or doors that allow side access to the interior of the bins.

The prior art is filled with myriad storage bins designed for storing and transporting articles of various sizes, shapes and weights. Many prior art bins are of the collapsible type, with side walls and end walls that are pivotally connected to the base of the bin so that the side walls and end walls can be folded over the base by pivoting them inwardly. The collapsibility of the bins facilitates their shipping and storage when empty.

Some of these prior art bins include means for providing accessibility to the interior of the bins from the side. Side access is desirable because it is safer and more efficient than leaning over and into the container when inserting or withdrawing articles from the container. This is particularly important for manufacturers and other businesses that work with particularly large or heavy articles, which require correspondingly large storage bins. It is also particularly important for workers that use such bins in an assembly line environment having strict time schedules and very little floor space. For example, an assembly line worker at a manufacturing facility may have only a few seconds to move a heavy article from one part of the assembly line into the interior of one of the bins. To address these concerns, some prior art bins have been designed with gates or access doors that provide accessibility from the side of the bin.

One such prior art bin includes a "drop gate" that is pivotally mounted in one of the side walls or end walls of the bin. The gate is opened by pivoting it downward relative to the bin about a horizontally disposed hinge axis to allow side access to the interior of the bin. However, the size of such drop gates is inherently limited. The hinge axis must be located no more than halfway down the side of the container so that the gate can be pivoted to a fully open position without hitting the floor or blocking fork lift channels in the lower portion of the bin.

Other prior art bins include a removable side wall that can be removed to provide access to the bin interior from the side. With the removable side wall removed, the width and height of the access opening is virtually the same as the width and height of the bin itself. However, when the removable side wall is removed, the bin loses the structural integrity that was provided by the removed side wall Such bins are also inefficient in an assembly line environment since workers must spend valuable time removing and later replacing the side wall. Also, the removed side wall panel may get separated from the bin.

SUMMARY OF THE INVENTION

The present invention pertains to a bin having features and advantages that overcome problems encountered in the prior art. The bin features a gate that is configured to provide a large side access opening of the bin without sacrificing the structural integrity of the bin. The structure of the bin is also advantageous because it allows access to an interior of the bin, from the side of the bin, without requiring workers to engage in any cumbersome or time-consuming exercises, such as removing and replacing side walls or side panels of the bin, in order to gain access to the interior from the side.

In general, a bin of the present invention comprises a base portion, opposing first and second side walls, an end wall and an access gate. The side walls are connected to the base portion and extend upwardly therefrom. The end wall is connected to a rearward edge of the base portion and extends upwardly therefrom between the first and second side wall. The access gate includes first and second leg members and at least one article retainer. The first leg member is operatively connected to a forward edge of the base portion, adjacent the first side wall, and extends generally upwardly from the base portion. The second leg member is operatively connected to a forward edge of the base portion, adjacent the second side wall, and extends generally upwardly from the base portion. The first and second leg members define the left and right margins of an access opening in the gate. The article retainer has a first end and a second end. The first end of the article retainer is connected to the first leg member of the gate. The article retainer is operable between an extended condition and an unextended condition When the article retainer is in its extended condition, it spans the access opening between the first and second leg members in a manner to prevent articles being carried in an interior of the bin from inadvertently falling out of the bin through the access opening. When the article retainer is in its unextended condition, the second end of the article retainer is movable generally toward the first end of the article retainer to provide unobstructed access to the interior of the bin through the access opening.

In another aspect of the present invention, a bin comprises a base portion, opposing first and second side walls, and opposing first and second end walls. The side walls and end walls are connected to the base portion and extend upwardly therefrom. The base portion, side walls and end walls together define an interior of the bin. One of the end walls constitutes an access gate having a cross member, opposing first and second leg members, and at least one flexible article retainer. The cross member extends generally horizontally adjacent a forward edge of the base portion between the first and second side walls. The opposing first and second leg members are connected to and extend generally upwardly from the cross member. The cross member and the first and second leg members define the boundary of an access opening in the gate. The flexible article retainer has a first end and a second end. The first end of the flexible article retainer is connected to the first leg member of the gate. The second end of the flexible article retainer is removably connectable to the second leg member of the gate. When the second end of the article retainer is connected to the second leg member of the gate, the article retainer spans the access opening between the first and second leg members in a manner to prevent articles being carried in the bin from inadvertently falling out of the bin through the access opening. When the second end of the article retainer is connected to the second leg member of the gate, the article retainer is in a generally taut condition. However, when the second end of the article retainer is removed from the second leg member of the gate, the article retainer is in a generally relaxed condition. In its relaxed condition, the flexibility of the article retainer permits the article retainer to be moved away from the access opening to thereby provide unobstructed access to the interior of the bin through the access opening.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
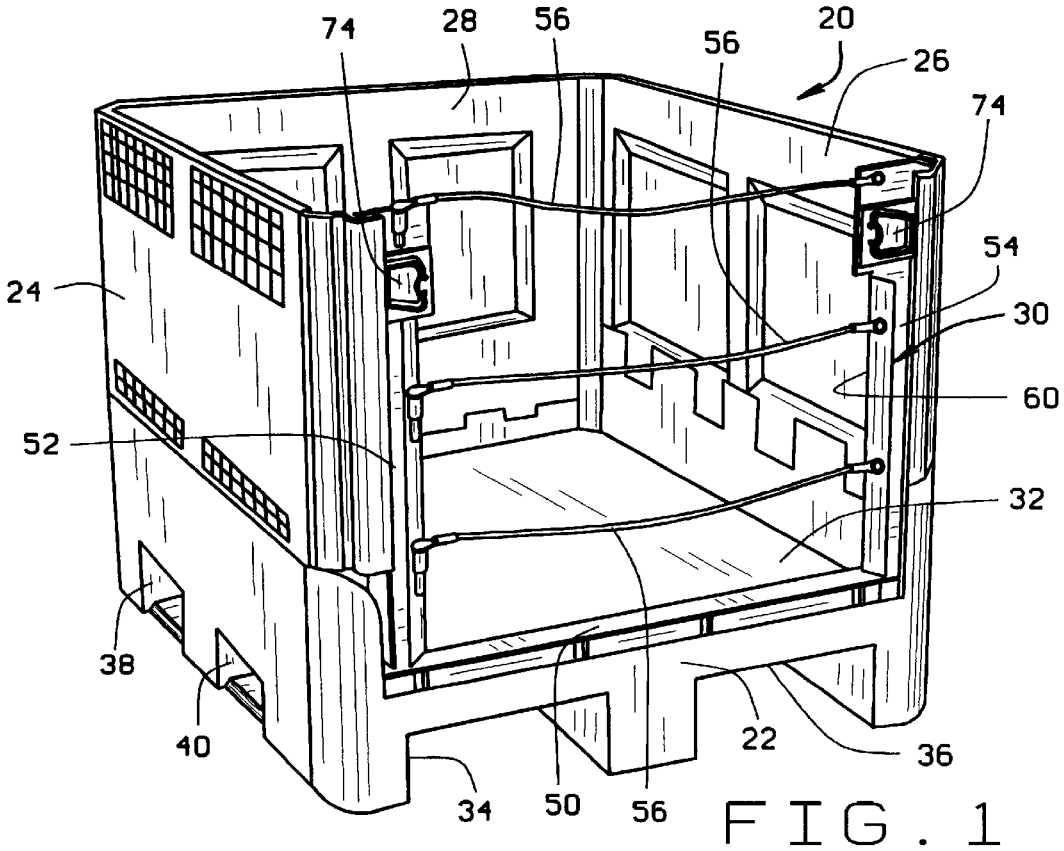
FIG. 1 is a perspective view of a bin of the present invention, with an access gate shown in an uncollapsed configuration.
Figure 2:
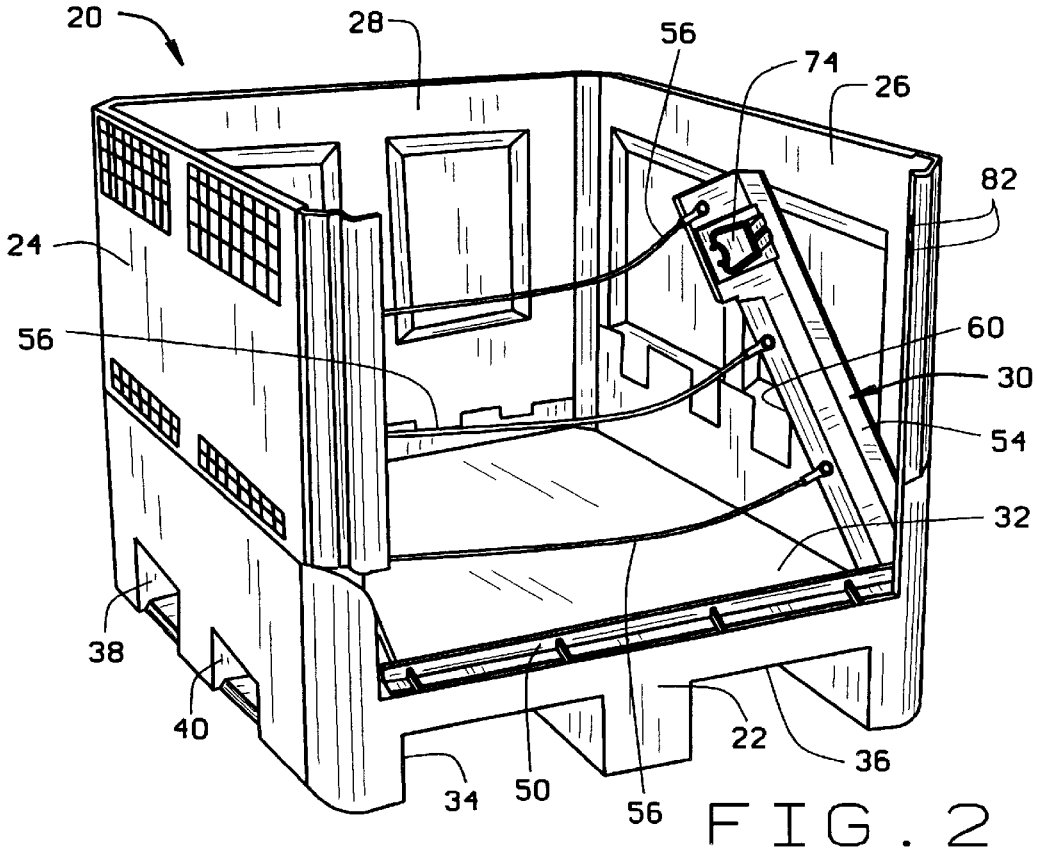
FIG. 2 is another perspective view of the bin of FIG. 1, with the access gate shown in a partially collapsed configuration.

Referring particularly to FIGS. 1 and 2, a bin or container of the present invention is represented generally by the reference numeral 20. As explained below, the bin 20 is preferably of the collapsible type. In general, the bin 20 comprises a generally horizontal base portion 22, opposing left and right side walls 24 and 26, a rear end wall 28 and an access gate 30. The left and right side walls 24 and 26 are connected to laterally opposite side edges of the base portion and extend upwardly therefrom when the bin 20 is in an erected (uncollapsed) condition of the bin shown in FIG. 1. The rear end wall 28 is connected to a rearward edge of the base portion 22 and extends upwardly therefrom between the first and second side walls 24 and 26 when the bin 20 is in its erected condition. The access gate 30, which represents a front end wall of the bin 20, is connected to a forward edge of the base portion 22 and extends upwardly therefrom between the first and second side walls 24 and 26, and opposite the rear end wall 28 when the bin 20 is in its erected condition. The base portion 22, left and right side walls 24 and 26, rear end wall 28 and access gate 30 together define an interior of the bin 20 when the bin 20 is in its erected condition.

For convenience, the walls 24, 26 and 28 are arbitrarily referred to throughout the specification as side walls and end walls. However, it should be understood that these terms can be used interchangeably, and that the relative dimensions of the side walls and end walls is not important. Preferably, the base portion 22, side walls 24 and 26, and rear end wall 28 are formed from high-density polyethylene or other suitable polymeric materials. However, these components could be formed from other materials without departing from the scope of the present invention.

Preferably, the left and right side walls 24 and 26, the rear end wall 28 and the access gate 30 are each pivotally mounted to the base portion 22 for pivoting movement between a collapsed configuration generally parallel to the base portion 22 and an uncollapsed (erect) configuration generally perpendicular to the base portion 22. Preferably, the pivot axes of the left and right side walls 24 and 26, the rear end wall 28 and the access gate 30 are vertically offset from one another to allow sequential collapsing of the walls 24,26 and 28 and gate 30 over one another.

The base portion 22 includes an upper surface 32 forming a bin floor, and a pair of spaced apart channels 34 and 36 configured to allow the bin 20 to be lifted by the tines of a fork lift (not shown). Preferably, the channels 34 and 36 pass all of the way through the base portion from front to rear, so that the bin 20 can be lifted by a fork lift from the front or rear. The base portion 22 also includes a pair of openings 38 and 40 pass all of the way through the base portion from left side to the right side to allow the bin 20 to be lifted by a fork lift from the left and right sides as well.

The access gate 30 includes a cross member 50, opposed left and right leg members 52 and 54 and a plurality of article retainers 56. As shown in FIG. 1, the cross member 50 extends generally horizontally along the forward edge of the base portion 22 between the left and right side walls 24 and 26. The left leg member 52 is connected to the cross member 50 adjacent the left side wall 24 and extends upwardly from the cross member 50 when the access gate 30 is in its uncollapsed configuration. The right leg member 54 is connected to the cross member 50 adjacent the right side wall 26 and extends upwardly from the cross member 50 when the access gate 30 is in its uncollapsed configuration. The cross member 50, left leg member 52 and right leg member 54 together define the boundary of a side access opening 60 in the gate 30. The left and right leg members 52 and 54 represent left and right side margins of the opening 60, and the cross member 50 represents a bottom margin of the opening 60. Preferably, the cross member 50 and the left and right leg members 52 and 54 are of a monolithic (one-piece) construction, and move together as a unit as the gate 30 moves between its collapsed configuration and its uncollapsed configuration.

Figure 8:
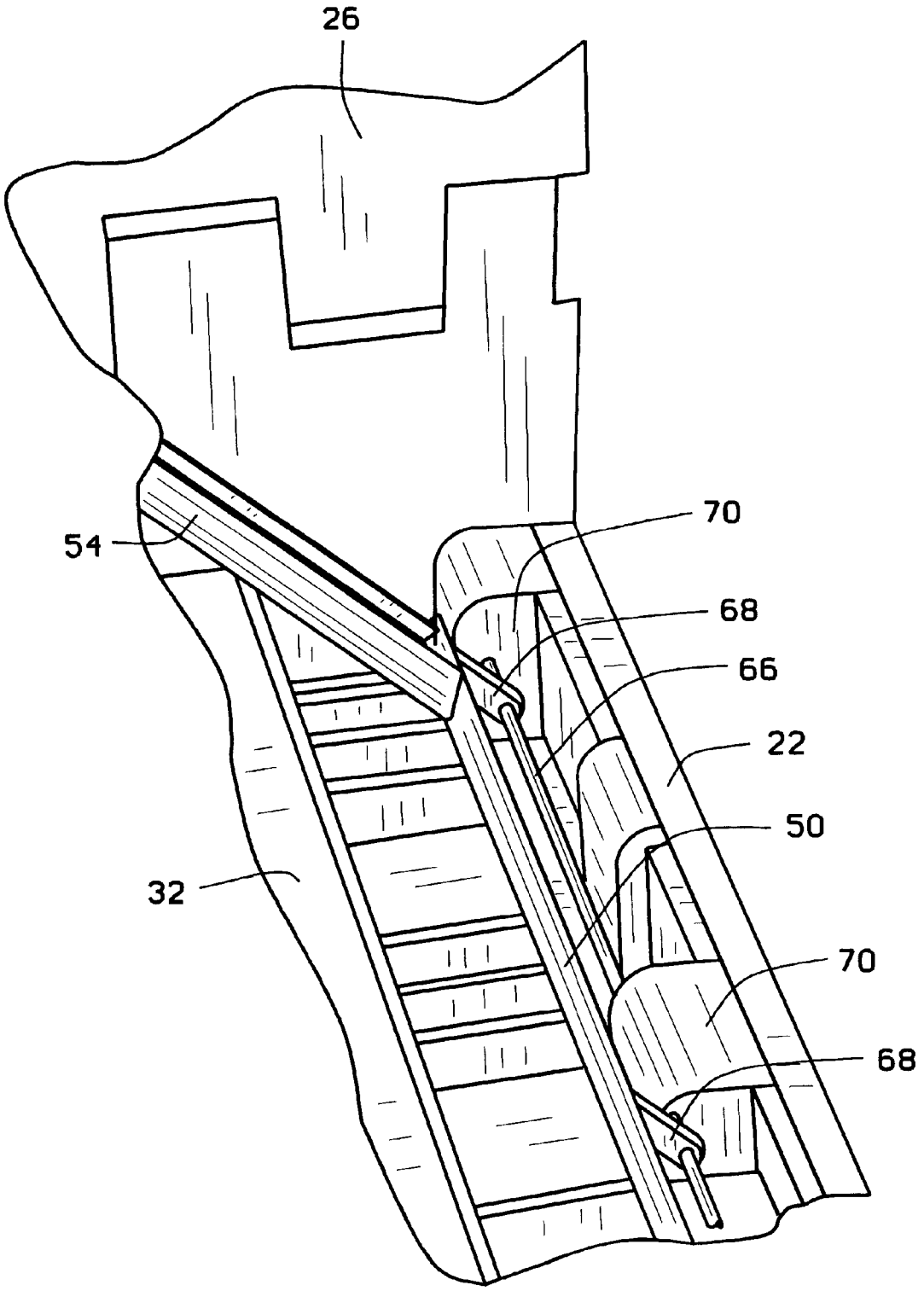
FIG. 8 is an enlarged, fragmented view showing detail of a pivotal connection between the access gate and a base portion of the bin of FIG. 1.

As shown in FIG. 8, the gate 30 is pivotally connected to the base portion 22 by a pivot rod 66. The cross member 50 of the gate 30 includes a plurality hinge links 68 depending from the bottom of the cross member 50. The hinge links 68 include holes near their distal ends to receive the pivot rod 66 therethrough. The base portion 22 includes a plurality of hinge bodies 70 extending from the base portion 22 and, preferably, are molded integrally therewith. The hinge bodies 70 include holes that are sized to receive the pivot rod 66 therethrough. Thus, the pivot rod 66 extends through the hinge links 68 and the hinge bodies 70 to allow the gate 30 to pivot relative to the base portion 22 between its collapsed and uncollapsed configurations. The left and right side walls 24 and 26 and the rear end wall 28 are connected to the base portion 22 in similar fashion for pivoting movement between their collapsed and uncollapsed configurations.

Figure 10:
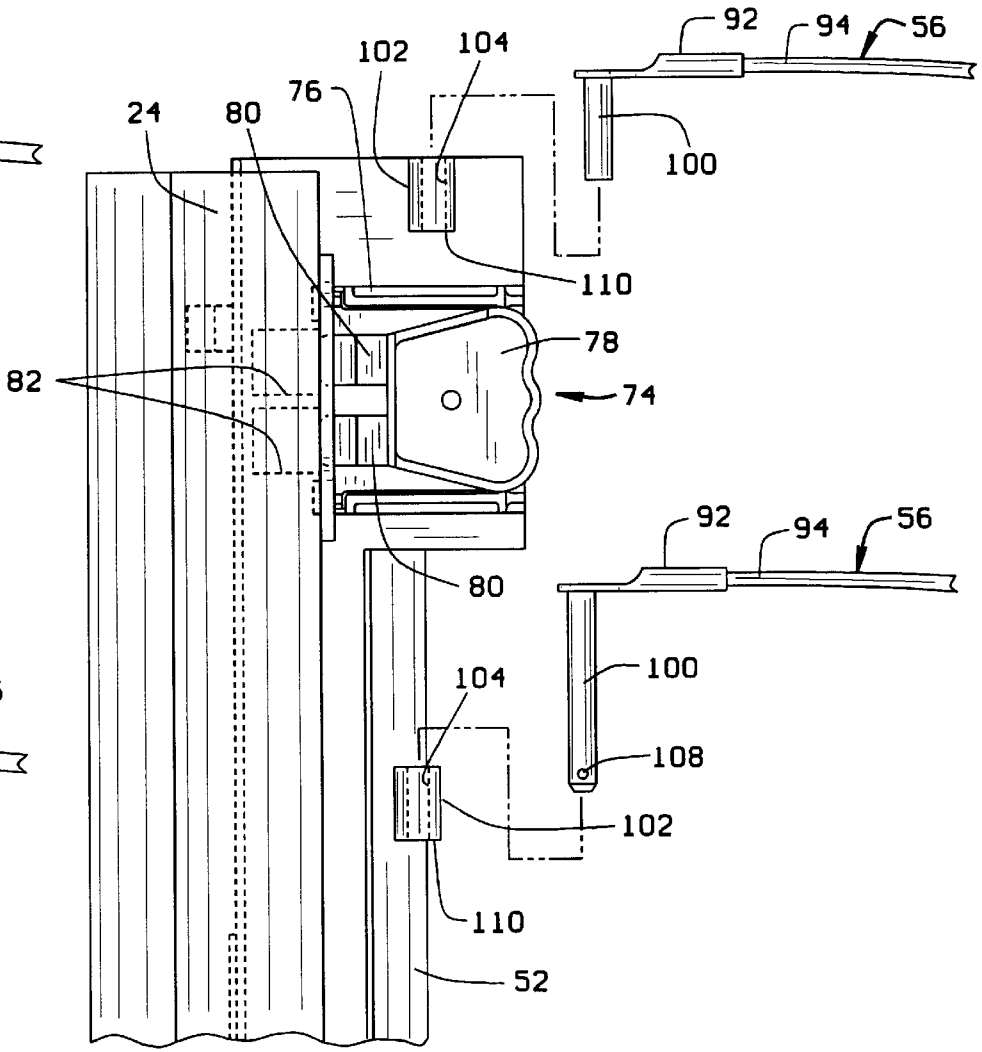
FIG. 10 is an enlarged, fragmented view similar to FIG. 9, with the article retainers being shown in an unextended and generally relaxed condition, and with the latch assembly being shown in an unlocked position.
Figure 9:
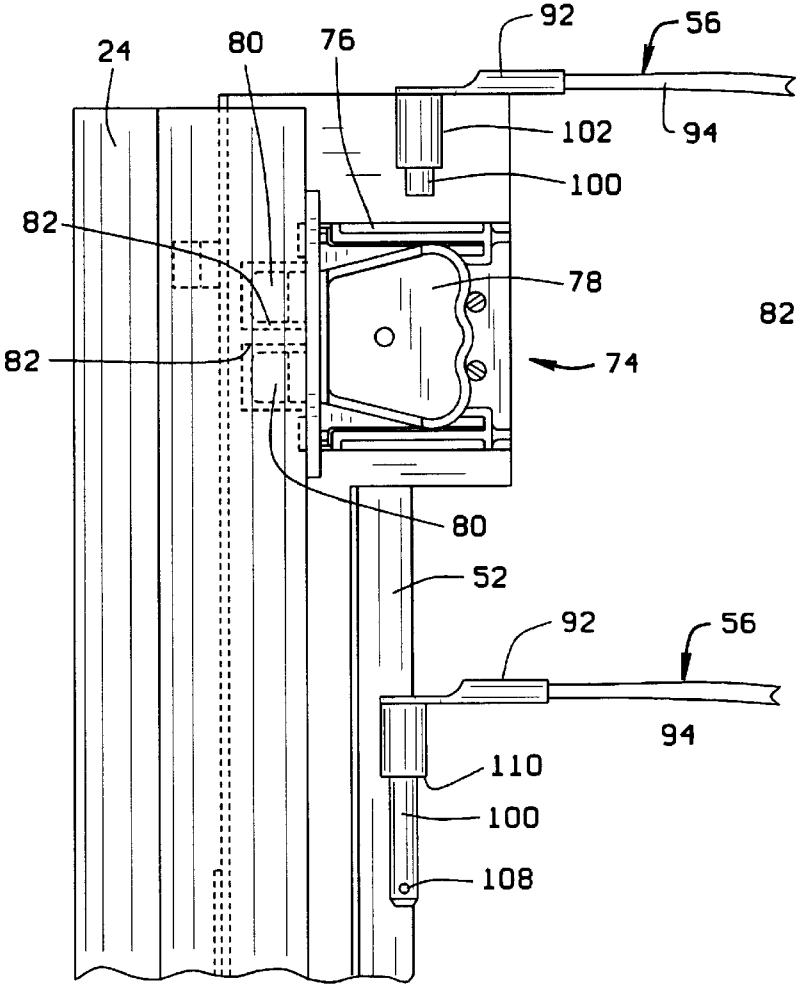
FIG. 9 is an enlarged, fragmented view of an upper end of a second leg member of the gate showing detail of two article retainers and a latch assembly, the article retainers being shown in an extended and generally taut condition, and the latch assembly being shown in a locked position.

As shown in FIGS. 1, 2, 9 and 10, the bin 20 preferably includes a pair of latch assemblies 74 configured for latching the gate 30 to the left and right side walls 24 and 26 when the gate 30 and side walls 24 and 26 are in their uncollapsed (or upright) configurations. Preferably, the latch assemblies 74 are of the type shown and described in commonly owned U.S. application Ser. No. 08/977,161, filed Nov. 24, 1997. The two latch assemblies 74 are preferably identical, and FIGS. 9 and 10 show one of the latch assemblies 74 in detail. The latch assembly 74 comprises a base member 76 and a locking member 78. Preferably, the base member 76 is fixed to the left leg member 52 of the gate 30. The locking member 78 is movably connected to the base member 76 and is moveable relative to the base member 76 between a locked position (shown in FIG. 9) and an unlocked position (shown in FIG. 10). The locking member 78 includes apair of tabs 80, which project from the locking member 78. The left and right side walls 24 and 26 each include notches 82, which are adapted to receive the tabs 80 when the locking members 78 are in their locked position. Thus, when the locking members 78 are in their locked position, the tabs 80 engage the notches 82 in the side walls 24 and 26 in a manner to prevent relative movement between the gate 30 and the left side wall 24 when the gate 30 and left side wall are in their uncollapsed or upright configurations. When the locking members 78 are in the unlocked position (FIG. 10), the tabs 80 are withdrawn from the notches 82 and the gate 30 is allowed to move relative to the side walls 24 and 26. Preferably, the latch assemblies 74 include an internal spring member (not shown) which biases the locking members 78 toward the locked position.

Figure 3:
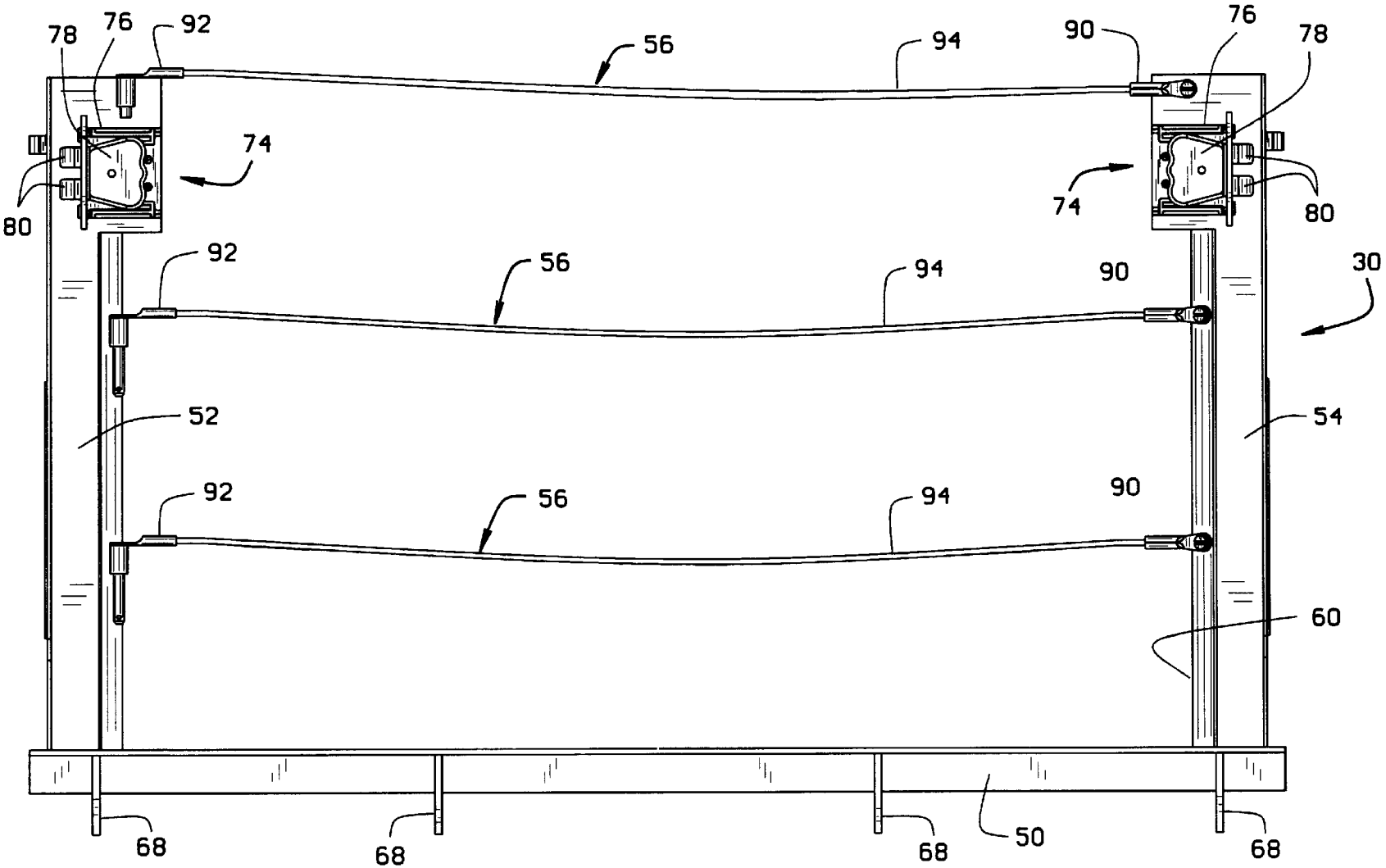
FIG. 3 is a front elevational view of the access gate employed in the bin of FIG. 1.
Figure 4:
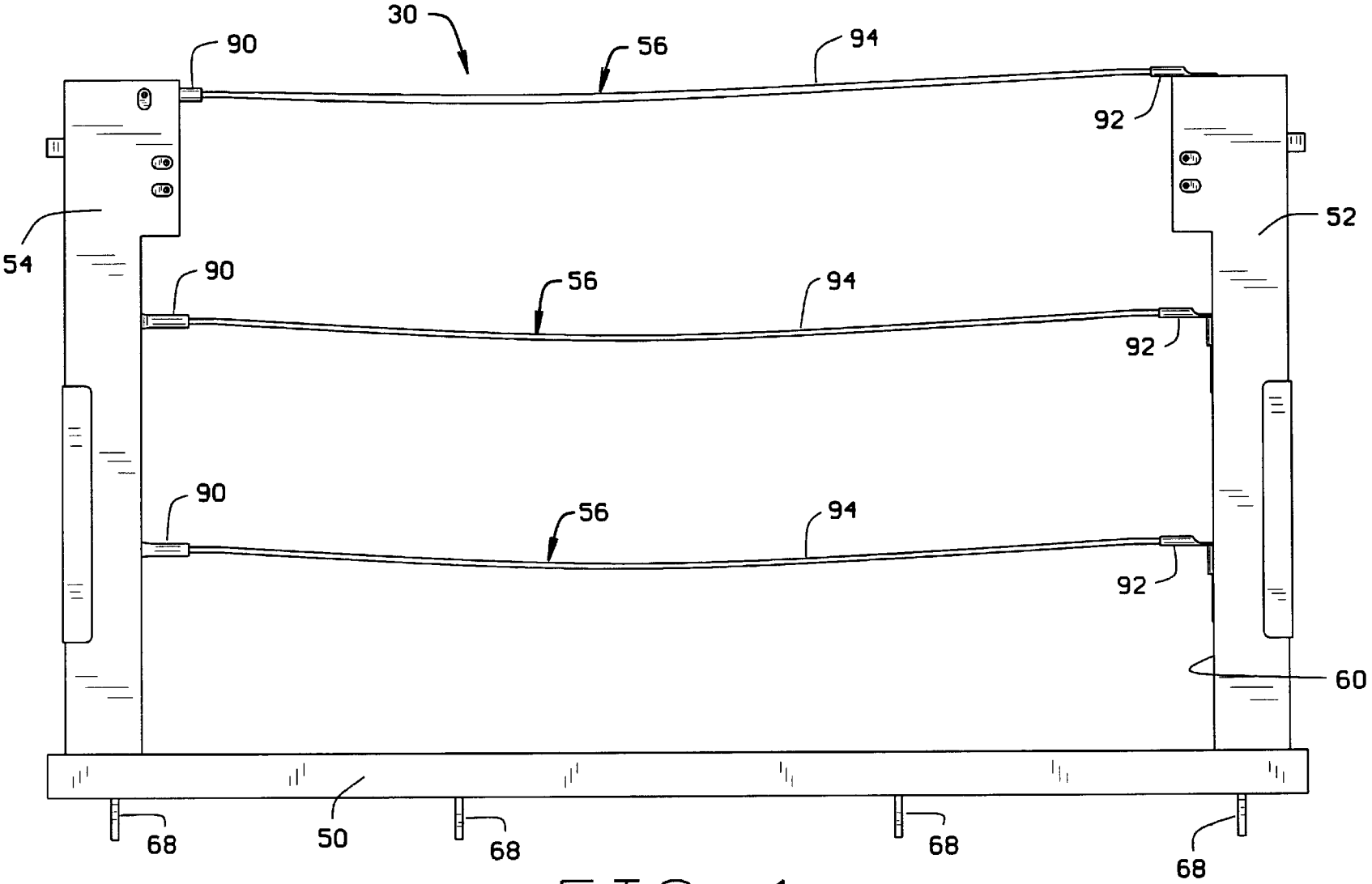
FIG. 4 is a rear elevational view of the access gate of FIG. 3.
Figure 6:
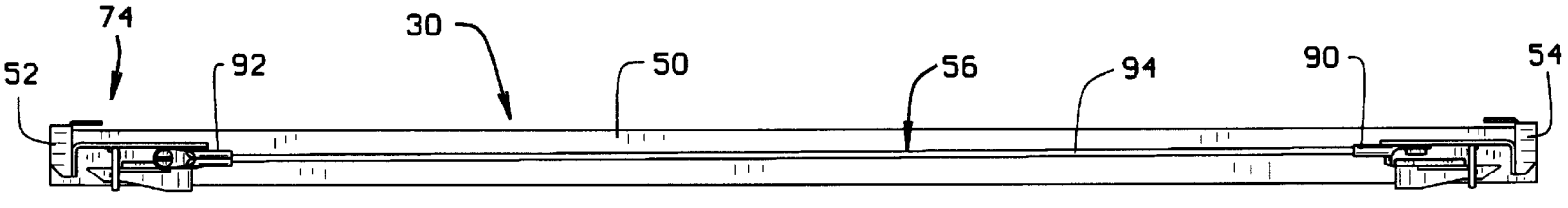
FIG. 6 is a top plan view of the access gate of FIG. 3.
Figure 7:
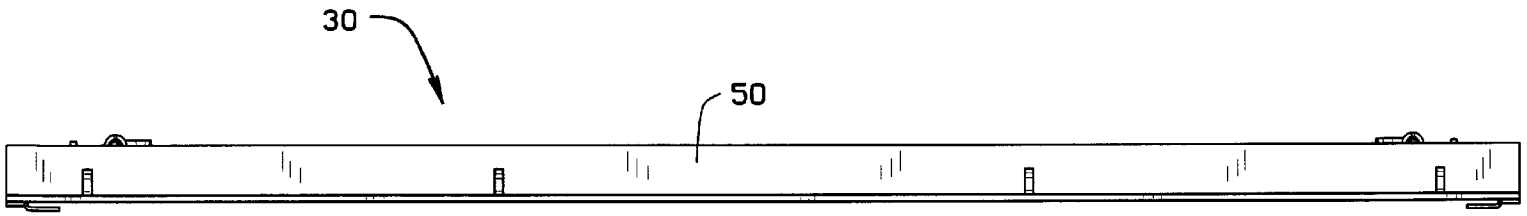
FIG. 7 is a bottom plan view of the access gate of FIG. 3.
Figure 5:
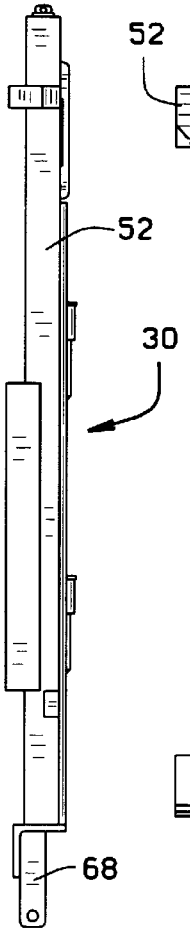
FIG. 5 is a left end elevational view of the access gate of FIG. 3.

As best shown in FIG. 3, each article retainer 56 has a first end 90 and a second end 92. Preferably, the first end 90 of each article retainer 56 is connected to the right leg member 54 of the gate 30 and the second end 92 of each article retainer 56 is removably connected to the left leg member 52 of the gate 30. However, the first end 90 of each article retainer 56 could be connected to the left leg member 52 and the second end 92 of each article retainer 56 could be connected to the right leg member 54, without departing from the scope of the present invention. Preferably, one end of each article retainer 56 is fixedly connected to one leg member of the gate to prevent the article retainers 56 from being separated from the bin 20 and lost However, both ends 90 and 92 of each article retainer 56 could be removable from the leg members 52 and 54 of the gate 30 without departing from the scope of the present invention.

Preferably, each article retainer 56 comprises a flexible cable 94 that extends between the first and second ends 90 and 92 of the article retainer 56. Preferably, the cable 94 consists of a bundle of flexible metal wires enclosed by an insulating sheath. However, the cable 94 could consist of a rope, wire, chain, cord, strip or other elongate member having similar characteristics of strength and flexibility. The cable 94 may or may not have elastic characteristics. As explained below, the flexibility of the flexible cable 94, allows the cable 94 to be bent, wound, retracted, rolled-up or otherwise moved out of the access opening 60. Thus, the flexibility of the flexible cable 94 permits the second end 92 of the article retainer 56 to be moved generally toward the first end 90 of the article retainer 56 to allow unobstructed access to the intenor of the bin 20 through the access opening 60.

Each article retainer 56 is operable between an extended condition (shown in FIGS. 1, 3, 4 and 9) wherein the second end 92 of the article retainer 56 is connected to the left leg member 52 and an unextended condition (shown in FIG. 10) wherein the second end 92 of the article retainer 56 is disconnected or removed from the left leg member 52. Preferably, the flexible cable 94 is generally taut when the article retainer 56 is in its extended condition with the second end 92 of the article retainer 56 connected to the left leg member 52 of the gate 30, and generally relaxed when the article retainer 56 is in its unextended condition with the second end 92 disconnected from the left leg member 52. Thus, as shown in FIGS. 1, 3, 4 and 9, each article retainer 56 preferably spans the entire access opening 60 between the left and right leg members 52 and 54 in a manner to prevent articles (not shown) being carried in the interior of the bin 20 from inadvertently falling out of the bin 20 through the access opening 60 when the article retainer 56 is in its extended condition. When the second end 92 of the article retainer 56 is disconnected or removed from the left leg member 52 of the gate 30, the second end 92 can be moved generally toward the first end 90 of the article retainer 56 (thereby putting the article retainer in its "unextended" condition) to provide unobstructed side access to the interior of the bin 20 through the access opening 60.

In the preferred embodiment described above, each article retainer 56 includes a flexible cable 94. However, in an alternative embodiment (not shown), the article retainer may comprise a plurality of telescoping or nesting members that are configured to telescope or nest with one another. A telescoping article retainer of this type is operable between extended and unextended conditions by selectively varying the amount of telescoping or nesting of the members. By increasing the amount of telescoping of the members, the second end of the telescoping article retainer could be moved toward the first end of the telescoping article retainer, thereby putting the article retainer in an "unextended" condition, which provides unobstructed side access to the interior of the bin 20 through the access opening of the gate 30. In another alternative embodiment, the article retainer may comprise a bellows-like member that can be drawn out or compressed like a bellows for operating the article retainer 56 between its extended and unextended conditions. Other alternative embodiments of the article retainer could be employed without departing from the scope of the invention.

As best shown in FIGS. 9 and 10, the gate 30 includes a locking mechanism for each article retainer 56 comprising a locking pin 100 and a generally tubular sleeve 102. The locking pin 100 is attached to the second end 92 of the article retainer 56, and the sleeve 102 is connected to the second leg member 54 of the gate 30. The sleeve 102 includes a bore 104 extending vertically through the sleeve 102. The bore 104 is sized and adapted to receive the locking pin 100 in a manner for releasably connecting the second end 92 of the article retainer 56 to the second leg member 54 of the gate 30 (see FIG. 9). Preferably, the locking mechanism includes a detent mechanism for preventing the locking pin 100 from inadvertently moving out of the sleeve 102 while the second end 92 of the article retainer 56 is connected to the second leg member 54. In general, detent mechanisms are known in the art. Preferably, the locking pin 100 includes a spring biased detent ball 108 near its distal end. The detent ball 108 is biased so that it projects outwardly from the locking pin 100. When the locking pin 100 is received within the sleeve 102, the detent ball 108 engages against a lower shoulder 110 of the sleeve to prevent the locking pin 100 from inadvertently moving out of the sleeve 102. Under normal operating conditions, forces exerted on the article retainers 56 (e.g., from articles contained within the interior of the bin or from objects outside of the bin) will result in the article retainers 56 being in tension. Preferably, the locking pin 100 and sleeve 102 are generally perpendicular to the flexible cable 94 so that, when the article retainer 56 is under tension, the detent mechanism provides sufficient resistance to prevent the locking pin 100 from coming out of the sleeve 102. The locking pin 100 can be removed from the sleeve 102 (see FIG. 10) by lifting the second end 92 of the article retainer 56 upwardly with enough force to move the detent ball 108 inwardly, against its bias, so that it clears the lower shoulder 110 of the sleeve. Although the locking mechanism shown in the Figures and described above represents the preferred embodiment of the present invention, other locking mechanisms could be utilized without departing from the scope of the present invention.

In view of the above, it will be seen that the several objects of the invention are achieved and other advantageous results attained.

As various changes could be made without departing from the scope of the invention, it is intended that all matter contained in the above description or shown in the accompanying drawings shall be interpreted as illustrative and not in a limiting sense.

What is claimed is:

1. A bin comprising:

a base portion;

opposing first and second side walls connected to the base portion and extending upwardly therefrom, each of the first and second side walls having a forward edge adjacent a forward edge of the base portion, the forward edges of the first and second side walls defining a first width;

an end wall connected to a rearward edge of the base portion and extending upwardly therefrom between the first and second side walls; and an access gate comprising first and second leg members and at least one article retainer, the first leg member being operatively connected to the forward edge of the base portion adjacent the first side wall and extending generally upwardly from the base portion, the second leg member being operatively connected to the forward edge of the base portion adjacent the second side wall and extending generally upwardly from the base portion, the first and second leg members defining the left and right margins of an access opening in the gate, the access opening having a second width less than the first width, the article retainer having a first end and a second end, the first end of the article retainer being connected to the first leg member of the gate, the article retainer being operable between an extended condition and an unextended condition, the article retainer spanning the access opening between the first and second leg members in a manner to prevent articles being carried in an interior of the bin from inadvertently falling out of the bin through the access opening when the article retainer is in its extended condition, the second end of the article retainer being movable generally toward the first end of the article retainer to provide unobstructed access to the interior of the bin through the access opening when the article retainer is in its unextended condition.

2. The bin of claim 1 wherein the article retainer laterally spans the entire access opening between the first and second leg members.

3. The bin of claim 1 wherein the gate further comprises a cross member extending generally horizontally adjacent a forward edge of the base portion between the first and second leg members, the cross member defining a bottom margin of the access opening in the gate.

4. The bin of claim 3 wherein the cross member and the first and second leg members are of a monolithic construction.

5. The bin of claim 1 wherein the article retainer is generally taut when it is in its extended condition and generally relaxed when it is in its unextended condition.

6. The bin of claim 1 wherein the article retainer includes a flexible member, the flexibility of the flexible member permitting the second end of the article retainer to be moved generally toward the first end of the article retainer.

7. The bin of claim 6 wherein the flexible member is generally taut when the article retainer is in its extended condition and generally relaxed when the article retainer is in its unextended condition.

8. The bin of claim 7 wherein the flexible member is a flexible cable.

9. The bin of claim 1 wherein the second end of the article retainer is removably connected to the second leg member of the gate when the article retainer is in its extended condition.

10. The bin of claim 9 wherein the gate includes a locking mechanism, the locking mechanism comprising a locking pin and a sleeve, the locking pin being connected to one of the second end of the article retainer and the second leg member, the sleeve being connected to the other of the second end of the article retainer and the second leg member, the sleeve having a bore adapted to receive the locking pin in a manner to releasably connect the second end of the article retainer to the second leg member.

11. The bin of claim 10 wherein the locking mechanism includes a detent mechanism adapted to prevent the locking pin from inadvertently moving out of the sleeve when the second end of the article retainer is connected to the second leg member.

12. The bin of claim 1 wherein the gate includes a plurality of article retainers spanning the access opening between the first and second leg members.

13. A bin comprising:

a base portion;

opposing first and second side walls connected to the base portion and extending upwardly therefrom;

an end wall connected to a rearward edge of the base portion and extending upwardly therefrom between the first and second side walls; and an access gate comprising first and second lea members and at least one article retainer, the first leg member being operatively connected to a forward edge of the base portion adjacent the first side wall and extending generally upwardly from the base portion, the second leg member being operatively connected to a forward edge of the base portion adjacent the second side wall and extending generally upwardly from the base portion, the first and second leg members defining the left and right margins of an access opening in the gate, the article retainer having a first end and a second end, the first end of the article retainer being connected to the first leg member of the gate, the article retainer being operable between an extended condition and an unextended condition, the article retainer spanning the access opening between the first and second leg members in a manner to prevent articles being carried in an interior of the bin from inadvertently falling out of the bin through the access opening when the article retainer is in its extended condition, the second end of the article retainer being movable generally toward the first end of the article retainer to provide unobstructed access to the interior of the bin through the access opening when the article retainer is in its unextended condition;

wherein the first and second leg members are connected to the base for pivoting movement between a collapsed configuration wherein the first and second leg members are generally parallel to the base and an uncollapsed configuration wherein the first and second leg members are generally perpendicular to the base.

14. The bin of claim 13 further comprising a latch assembly adapted for releasably latching the first and second leg members to the first and second side walls, respectively, when the first and second leg members are in their uncollapsed configuration.

15. A bin comprising:

a base portion;

opposing first and second side walls connected to the base portion and extending upwardly therefrom, each of the first and second side walls having a forward edge adjacent a forward edge of the base portion, the forward edges of the first and second side walls defining a first width; and opposing first and second end walls connected to the base portion and extending upwardly therefrom, the base portion, side walls and end walls together defining an interior of the bin;

one of said end walls constituting an access gate, the gate having a cross member, opposing first and second leg members, and at least one flexible article retainer, the cross member extending generally horizontally adjacent the forward edge of the base portion between the first and second side walls, the opposing first and second leg members being connected to and extending generally upwardly from the cross member, the cross member and the first and second leg members defining the boundary of an access opening in the gate, the access opening having a second width less than the first width, the flexible article retainer having a first end connected to the first leg member of the gate and a second end removably connectable to the second leg member of the gate, the article retainer spanning the access opening between the first and second leg members in a manner to prevent articles being carried in the bin from inadvertently falling out of the bin through the access opening when the second end of the article retainer is connected to the second leg member of the gate, the article retainer being generally taut when the second end of the article retainer is connected to the second leg member of the gate, the article retainer being in a generally relaxed condition when the second end of the article retainer is removed from the second leg member of the gate, the flexibility of the article retainer permitting the article retainer to be moved away from the access opening when the article retainer is in its relaxed condition to thereby provide unobstructed access to the interior of the bin through the access opening.

16. The bin of claim 15 wherein the article retainer is adapted so that the second end of the article retainer is movable generally toward the first end of the article retainer to move the article retainer away from the access opening.

17. The bin of claim 15 wherein the cross member and the first and second leg members are of a monolithic construction.

18. The bin of claim 15 wherein the flexible article retainer includes a flexible cable.

19. The bin of claim 15 wherein the gate includes a locking mechanism, the locking mechanism comprising a locking pin and a sleeve, the locking pin being connected to one of the second end of the article retainer and the second leg member, the sleeve being connected to the other of the second end of the article retainer and the second leg member, the sleeve having a bore adapted to receive the locking pin in a manner to releasably connect the second end of the article retainer to the second leg member.

20. The bin of claim 19 wherein the locking mechanism includes a detent mechanism adapted to prevent the locking pin from inadvertently moving out of the sleeve when the second end of the article retainer is connected to the second leg member.

21. The bin of claim 15 wherein the gate is connected to the base for pivoting movement of the gate relative to the base between a collapsed configuration wherein the first and second leg members of the gate are generally parallel to the base and an uncollapsed configuration wherein the first and second leg members of the gate are generally upright.

22. The bin of claim 21 further comprising a latch assembly adapted for releasably latching the gate to at least one of the first and second side walls when the gate is in its uncollapsed configuration.

23. The bin of claim 1, wherein the bin is collapsible.

24. The bin of claim 15, wherein the bin is collapsible.

* * * * *